US005526865A

United States Patent [19]

Coenraets

[11] Patent Number: 5,526,865

[45] Date of Patent: Jun. 18, 1996

[54] CLOSING, SEPARATING OR COVERING DEVICE

[75] Inventor: Benoit J. Coenraets, Humbeek, Belgium

[73] Assignee: Dynaco International, Brussels, Belgium

[21] Appl. No.: 142,371

[22] PCT Filed: May 15, 1992

[86] PCT No.: PCT/BE92/00017

§ 371 Date: Nov. 23, 1993

§ 102(e) Date: Nov. 23, 1993

[87] PCT Pub. No.: WO92/20895

PCT Pub. Date: Nov. 26, 1992

[30] Foreign Application Priority Data

May 24, 1991 [BE] Belgium ..... 9100499

[51] Int. Cl.[6] ..... E06B 9/17

[52] U.S. Cl. ..... 160/272; 160/273.1

[58] Field of Search ..... 160/272, 273.1, 160/268.1, 376, 329; 16/95 R, 96 R

[56] References Cited

U.S. PATENT DOCUMENTS

| | | | |
|---|---|---|---|
| 1,632,742 | 6/1927 | Minard | 160/272 |
| 1,736,432 | 11/1929 | Dixson | 160/273.1 X |
| 1,840,454 | 1/1932 | Kennedy | 160/273.1 |
| 5,131,450 | 7/1992 | Lichy | 160/273.1 X |

*Primary Examiner*—Blair M. Johnson

*Attorney, Agent, or Firm*—Lackenbach Siegel Marzullo Aronson & Greenspan

[57] ABSTRACT

Closing, separating or covering device comprising a blind (1) capable of being wound about a winding axis with flexible lateral edges (2) held in position in guide tracks (3) during winding and unwinding, wherein the latter (3) are elastically mounted on a support or rotatably mounted about an axis substantially parallel to their longitudinal axis such that the said lateral edges (2) can be held in position in the guide tracks during the displacement by rotation and/or translation of the latter in relation to the support (4).

15 Claims, 4 Drawing Sheets

CLOSING, SEPARATING OR COVERING DEVICE

This invention concerns a device for closing a bay, separating off a room or covering a swimming pool, silo etc., comprising a blind which can be wound around a winding axis with flexible lateral edges held in position in guide tracks during winding and unwinding of said blind.

Especially for blinds with a relatively large area, when such blinds are unwound to cover a bay, for example, the pressure acting essentially perpendicular to one of its surfaces can be relatively large, in particular for blinds exposed to the wind.

As a consequence, in the known closing devices of this type, the guide tracks in which the edges of the blind move and are held, can be subjected to very uneven forces from one side of the blind, as opposed to the other side of said blind. It may even happen that all the forces exerted by the above-mentioned edges may be concentrated on a single side of the blind, thus creating torsion on certain parts of said guide tracks, resulting in irregular wear both of the guide tracks and of the edges of the blind, and moreover a greater risk of said edges suddenly coming free of the guide tracks and damaging them as a result.

Another not inconsiderable disadvantage of closing devices of certain dimensions is fitting the blind, which generally requires laborious preparation by specialized workers to ensure that the edges of the blind slide with controlled friction in the guide tracks, that winding and unwinding are uniform, and that the blind is perfectly plane in its unwound position. The main aim of the invention is to overcome the above-mentioned disadvantages, in an extremely simple but very effective way.

To this end, according to the invention, the above-mentioned guide tracks are mounted on a support in an elastic manner and/or pivoting about an axis essentially parallel to the longitudinal axis of said guide tracks, such that said lateral edges can be held in the guide tracks during displacement of said guide tracks in relation to the support.

Advantageously, the guide tracks are mounted by elastic means on the support, such that they can undergo a displacement in the direction of the blind when a force is exerted on the latter.

In a particular embodiment of the invention, the guide tracks are mounted on rods extending essentially vertically to the longitudinal axis of said guide tracks and mounted with a certain amount of play in holes in the surface of the support, the elastic means comprising a helical spring slid over the above-mentioned rod, on the side of this surface opposite the guide tracks, pushing against said surface.

Other details and features of the invention will be apparent from the following description, given by way of example only, without being limitative, of several embodiments of the invention, with reference to the attached drawings, where:

In the different figures, the same reference numbers refer to the same or analogous elements.

Figure 1:
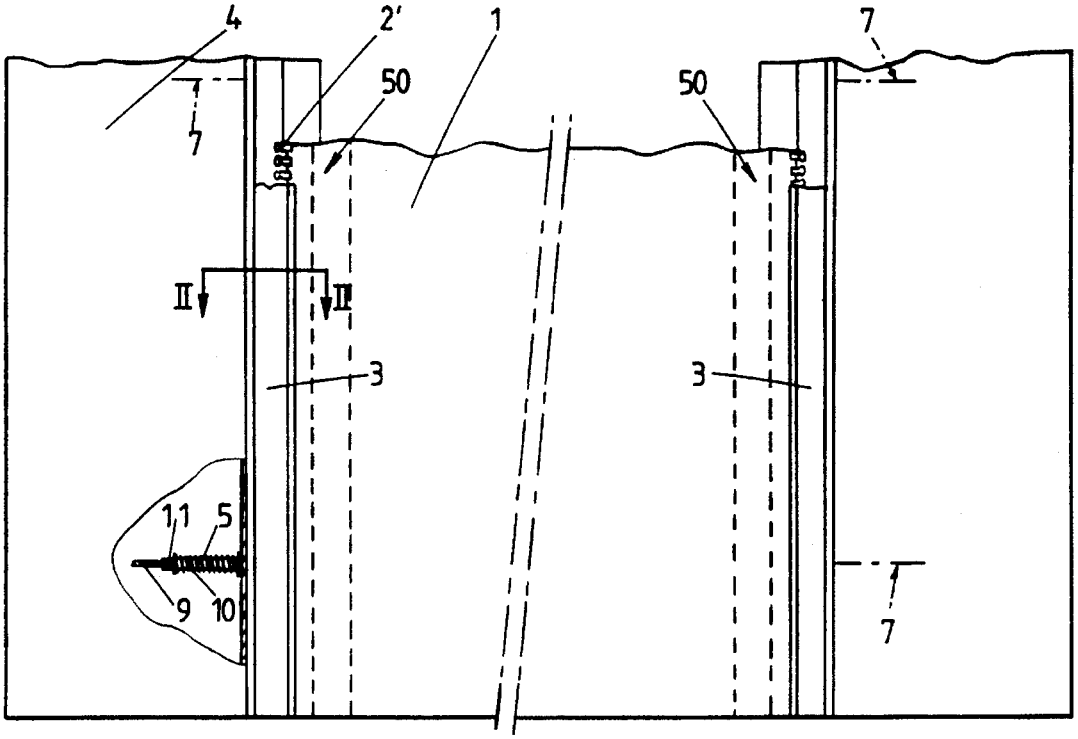
FIG. 1 is an elevation, with partial break lines, of a first embodiment of the invention.
Figure 3:
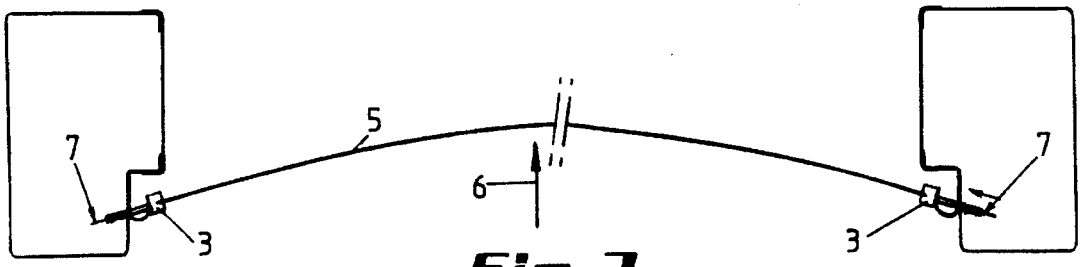
FIG. 3 is a schematic representation of a horizontal section of this embodiment, showing the position of the device under the action of a horizontal force acting on the blind.
Figure 2:
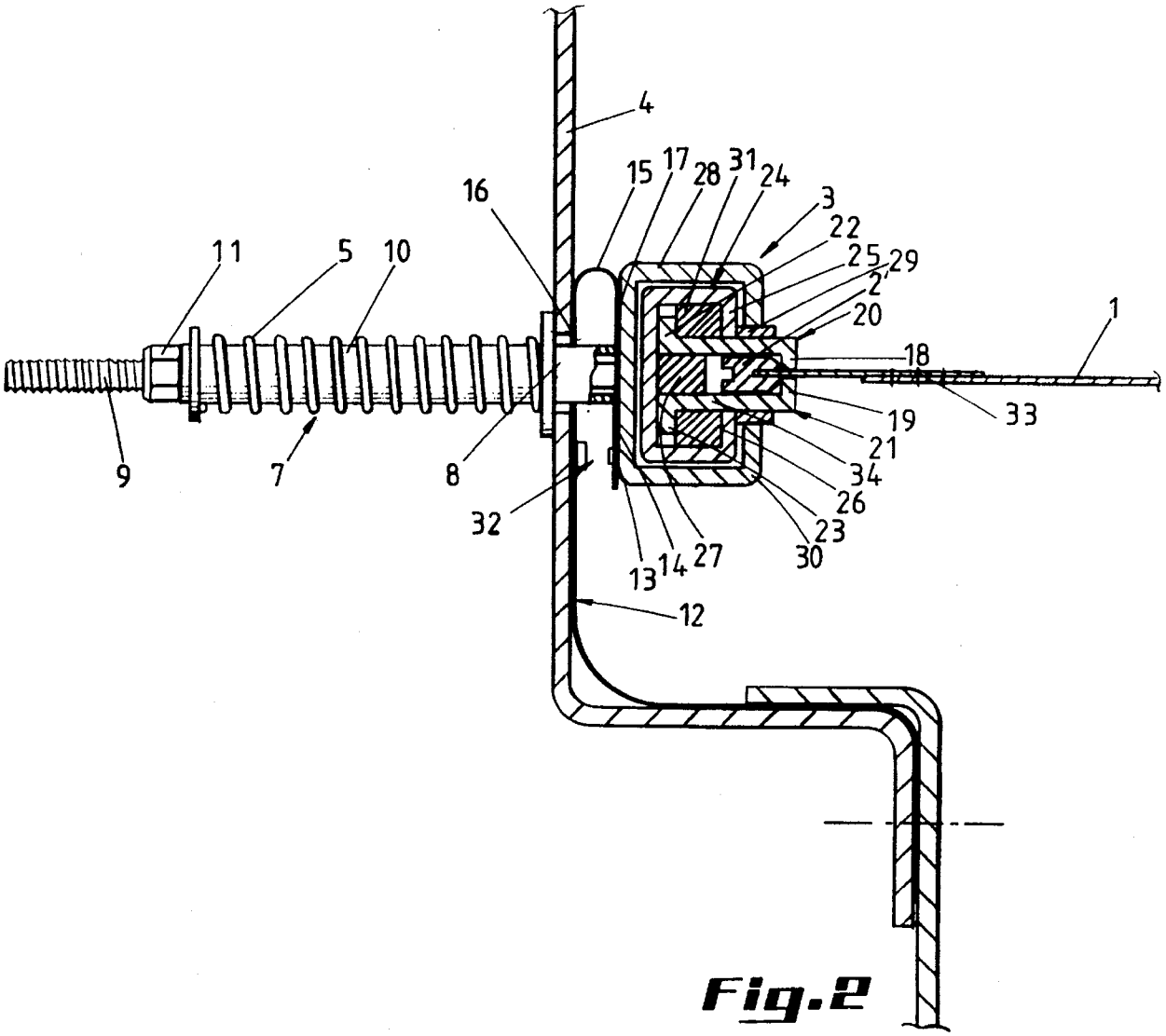
FIG. 2 is a section along line II—II in FIG. 1, to a greater scale.

The embodiment of the closing device according to the invention, as shown in FIGS. 1 to 3, comprises a blind 1 which can be wound around a winding axis (not shown), e.g. for closing off a bay, such as a garage, workshop or hangar entrance, or as a room partition, or as a cover for swimming pool, silo etc.

This blind 1 has lateral flexible edges 2 which project from the plane of the blind and are held sliding in the guide tracks 3, said guide tracks being located laterally on either side of e.g. the bay to be closed off.

The device is essentially characterized in that the guide tracks 3 are mounted on a support 4 which delimits the bay laterally, in an elastic manner and/or pivoting about an axis essentially parallel to the longitudinal axis of said guide tracks, such that the lateral edges 2 of the blind can continue to be held in said guide tracks during displacement of the latter in relation to the support 4.

In fact, all the parts of the guide track which hold the edge of the blind are mounted elastically and/or in a pivoting manner on the support 4. However, means may be provided to free said lateral edges 2 from their guide tracks if the traction force exerted on said guide tracks by the blind exceeds a certain value. For example, the guide tracks may have a certain elasticity, so that they can open when a certain traction is exerted on the blind. Another possibility is for certain parts of the guide tracks to be mounted so that they rotate with respect to other parts of said guide tracks, so that they can open and thus free the lateral edges of the blind when the latter is subjected to a certain force. Such a possibility is described and represented in European patent application 0405093. In general terms, the invention concerns guide tracks mounted by their base, elastically and/or so that they can rotate, on a fixed support 4; it does not concern the parts of said guide track intended for the actual holding and guiding.

More particularly, in this specific embodiment of the closing device according to the invention, the guide tracks 3 are mounted through helical springs 5 on the support 4, such that they can undergo a displacement in the direction of the blind 1 when a force illustrated by the arrow 6 in FIG. 3 is applied to said blind.

The guide tracks 3 are fitted to rods 7 extending perpendicular to the longitudinal axis of said guide tracks, said rods 7 being mounted with a certain amount of play in holes 8 in the surface of support 4; in this embodiment, the latter takes the form of a metal casing.

The helical springs 5 are slid over the rods 7 inside the casing and press against the inside surface of said casing, i.e. the side opposite the surface on which the guide track 3 is mounted.

The rods 7 have a threaded free end 9 and are each mounted coaxially in a sleeve 10 passing with a certain amount of play through holes 8 in the support casing 4, said sleeve being immobilized with respect to the guide track by a nut 11 screwed onto the threaded free end 9 of the rods 7. Accordingly, the springs 5, which are slid over the sleeve 10, are held with a certain amount of compression between the nut 11 and the inside face of the wall of the casing of the support on which the guide track 3 is mounted. In this manner, the springs exert a certain traction on the guide track 3, in a direction perpendicular to the longitudinal axis of said guide track.

In order to ensure sealing between the support casing 4 and the guide track 3, independently of the distance between them, a flexible sealing strip 12, for example in rubber or plastic, is fitted between the guide track 3 and the support casing 4.

One of the longitudinal, lateral edges 13 of the sealing strip 12 has holes through which the rods 7 run. Said rods 7 are attached at regular intervals from each other to the back 14 of the guide tracks 3, as clearly shown in FIG. 1. This edge 13 is held against the back 14 of the guide track 3 through the free end of the sleeves 10 acting towards this back and pressing against it around the holes.

Further, in order to enable the sealing strip to follow the variations in the spacing between the guide track 3 and the support casing 4 on which it is mounted, the sealing strip 12 forms a loop 15 between the guide track 3 and the support casing 4. Accordingly, the rods 7 pass freely through a hole in the branch 16 of a the loop 15 on the side towards the support casing 4, so that said loop can move freely over the sleeve 10 slid over the rod 7. The other branch 17 ends in the free edge 13 and is held against the back 14 of the guide track by the free end of the sleeve 10, as described above.

In the particular embodiment of the invention illustrated in FIGS. 1 to 3, the projecting lateral ends 2 of the blind 1 are formed by a succession of small, identical, juxtaposed blocks 2', preferably made of a hard plastic material, located in line with each other and linked to each other in a well-known flexible manner, for example like the teeth of zipper. The blocks can in fact be as close together as possible, provided the lateral edges 2 remain sufficiently flexible to enable the blind to be wound around an axis.

Also in this particular embodiment of the invention, the guide tracks 3 each have two longitudinal rims 18 and 19 situated on either side of the blind 1 and pointing towards each other in a direction essentially perpendicular to the blind. Accordingly, the guide tracks 3 surround the projecting edge 2 of the blind 1.

These two longitudinal rims 18 and 19 holding the projecting edge 2 of the blind 1 in the guide tracks form part of two separate sections 20 and 21 in a material which is elastic to a certain extent, each having a cross section essentially in the form of a Z. One of the two flanges of said sections 20 and 21 forms the above-mentioned longitudinal rim, 18 and 19 respectively, while the other flange 22 or 23 respectively forms the base of said sections, which in turn is held in a rigid metal U-section 24, whose flanges also have rims 25 and 26 pointing towards each other. The two Z-sections 20 and 21 are held in the U-section 24 by a spacer bar 27 packed into said U-section between the bases of the two sections 20 and 21, and by another spacer bar 31 located on either side of said sections and the neighbouring flange of the U-section. Said U-section is held in a support section 28, also U-shaped, whose flanges have rims pointing towards one another. The L-section bars 29, preferably also made of a relatively elastic material, for example of the same kind as for the Z-sections 20 and 21, are engaged in the joints between the edges 30 of the support section 28 and the Z-sections, so that said L-section bars 29 push laterally against said Z-sections, thus controlling their lateral flexibility. The fact that the Z-sections 20 and 21 which hold the projecting edges 2 of the blind 1 have a certain elasticity enables these edges to come out of the guide track 3 when a certain force is applied to the surface of the blind 1.

Contacts 32 can for example be fitted between the guide track 3 and the support 4 in order to detect when the projecting edge 2 of the curtain 1 comes out of the guide track and/or the force 6 exerted by the blind 1 exceeds a certain limit. Said contacts 32 are preferably connected to an alarm circuit, for example in order to deactivate and stop the winding or unwinding movement, or simply to activate a warning device. These contacts can also be fitted inside the casing, to cooperate with the rods 7.

In another embodiment of the invention, means can advantageously be provided to intercept the force 6 acting on the blind at the moment it reaches a certain limit, without the projecting edge 2 coming out of the guide tracks 3. Accordingly, the projecting edge 2 can for example be fixed to the blind by means having low strength, extending between the blind and its projecting edges 2. These means can for example be formed by a strap and pins with strength calculated so that the pins break whenever the force 6 reaches a predetermined limit. There can also be a zone 33 of low strength between the projecting edge 2 and the surface of the blind which yields whenever the force acting on the surface of the blind reaches a certain level, which must be less than the force necessary to make the projecting edge 2 come out of its guide track.

Figure 4:
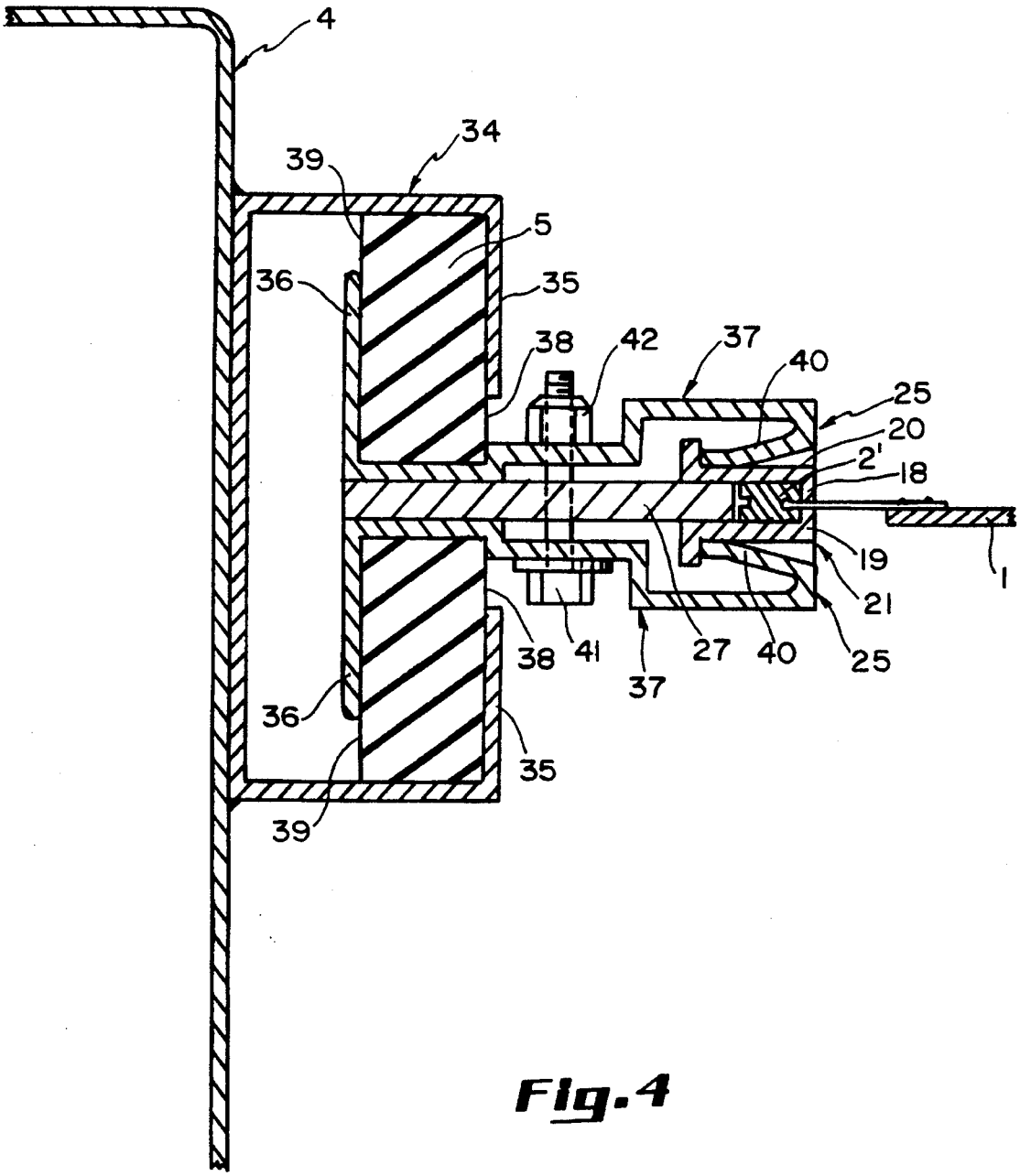
FIG. 4 is a cross section, analogous to that in FIG. 2, of a second embodiment of the device according to the invention.

The embodiment of the device according to the invention shown in FIG. 4 differs from that shown in FIG. 2 mainly in that the elastic means are formed by foam elements 5 with significant elasticity, such as polyurethane or latex foam. Said elements 5 extend over the whole length of the guide track 3, thus ensuring sealing between said guide track 3 and the support 4 on which it is mounted, without an additional sealing strip being necessary as in the previous embodiment. Said foam elements 5 are made up of short bars with rectangular section, fitted inside a U-section 34 welded to the outside surface of the support casing 4. The side flanges of said section 34 have rims 35 pointing towards each other, against which one of the faces 38 of the foam elements 5 rests.

Further, the Z-sections 20 and 21 are fixed along their whole length in a detachable way between two identical plates 37, one of whose longitudinal edges has the shape of a hook (25), thus holding the sections 20 and 21 in place, with the opposite longitudinal edge having support flanges 36 acting against the face 39 of the foam elements 5 opposite the face resting against the rims 35 of the section 34.

A spacer flat 27 extends between the two plates 35 and the bases of the sections 20 and 21, thus determining the distance between them. Further, the hook-shaped edges 25 rest in an elastically adjustable manner against the sections 20 and 21, so controlling the force acting through said sections on the edges 2 of the blind 1, in particular the force necessary to make the edges 2 come out of the guide track 3.

To this end, the free ends 40 of the hooks 25 are slightly inclined and push elastically against the sections 20 and 21, and a bolt passing through the plates 37 and the spacer flat 31 enables the pressure exerted on the free edges 40 of said sections 20 and 21 to be adjusted by means of a nut 42 screwed onto said bolt 41.

Figure 5:
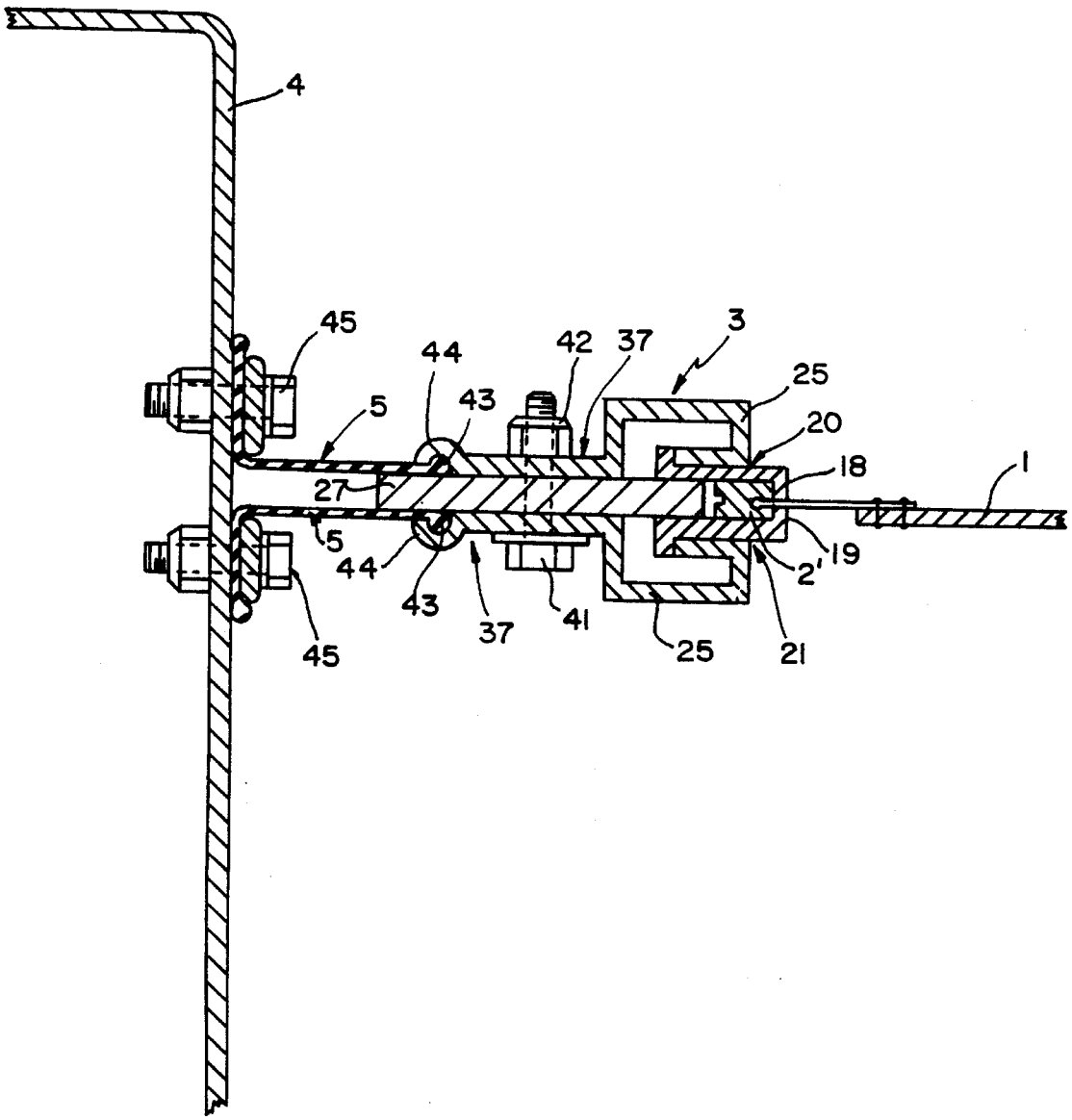
FIG. 5 is also a cross section, analogous to that in FIG. 2, of a third embodiment of the device according to the invention.

The embodiment of the device according to the invention shown in FIG. 5 differs from that in FIG. 4 mainly in that the elastic means are made up of two strips 5 of elastic material, such as rubber or a plastic elastomer, said strips being subjected to a tension force, while in the embodiment shown in FIG. 4 the foam bars 5 are subjected to a compression force. One of the lateral edges of these strips 5 has a beading 43 held in a groove 44 in the plates 37 which rest against the spacer flat 31. The other lateral edge of these strips is folded against the outside surface of the support casing 4 and held against it by regularly spaced bolts 45. These strips 5 extending over the whole length of the guide track 3 thus also form a seal between the latter and the support casing 4.

It can also be important for there to be a stopping means to limit the displacement of the guide tracks 3 in the direction of the blind 1 when a force 6 is applied to said blind.

In the case of the embodiment shown in FIG. 2, the stop is automatically obtained when all the turns of the spring are pressed against each other. If the elastic means take the form of foam elements, the stop is obtained when these elements are fully compressed. If elastic strips subjected to a tension force are used, it could be important to incorporate a core within them, so as to limit their extension in the direction of the tension.

One of the advantages of the embodiments according to FIGS. 4 and 5 is that all the accessories of the guide track 3 are situated outside the support 4, so that where necessary the support can take the form of a solid wall, such as concrete pillar.

Due to the fact that the guide tracks 3 are mounted on their support 4 through elastic means, practically no adjustment is necessary on the worksite; the guide tracks and their corresponding supports can be assembled entirely in the factory.

Furthermore, thanks to these elastic means, the blind is constantly under controlled, horizontal tension, and the expansion or contraction due to changes in temperature is automatically compensated by the elastic means. The same applies to variations in distance between the guide tracks at different points, for example if they are not perfectly parallel.

Due to the fact that the guide tracks can pivot about an axis parallel to their longitudinal axis, the tension exerted by the blind 1 through the edges 2 is always divided evenly between the two sections 20 and 21, in particular the two rims 18 and 19 of said sections 20 and 21, and always in a direction essentially parallel to the web 34 of said sections 20 and 21.

Accordingly, it is perfectly possible to determine, in a rigorous enough way, the physical characteristics which the sections 20 and 21 must have in order for the edge 2 to come out of the guide tracks 3 above a certain force applied to the blind 1. Moreover, thanks to the fact that the frictional force of the edge 2 is divided symmetrically between the two sections 18 and 19, the wear on the edge and on the sections is uniform and reduced to a strict minimum, thus significantly increasing the life of these elements.

It should be understood that the invention is in no way limited to the particular embodiment described above and shown in the figures, and that different variations are possible within the scope of the invention; for example, for certain applications or types of device, the guide track 3 could be mounted on the support 4 through a hinge or successive series of hinges whose axis of rotation is parallel to the axis of said guide track.

Furthermore, in other cases these guide tracks can be mounted on their supports so that they only undergo a translation in the direction of the plane of the blind in the closed position, without the elastic means permitting the guide track to pivot.

However, it goes without saying that there is a marked preference for a system in which the guide track can undergo pivoting and elastic translation simultaneously.

In yet other cases, the edge 2 of the blind 1 can be fitted with guiding means which are spaced out, such as runners or sliding blocks spread out at a certain distance from each other along the edge of the blind, i.e. the projecting edge is not essentially continuous.

Finally, in a particular embodiment of the invention, the blind 1 comprises a tarpaulin and has an essentially elastic zone 50 formed by e.g. a strip of elastic material, as shown schematically in FIG. 1, extending over the whole length of the blind 1, in the direction of its lateral edges. This zone 50 can in principle be located at any part of the blind, but for reasons of symmetry it will preferably be located e.g. near each of the lateral edges 2 or possibly in the middle. However, there could be a single elastic zone near one of the two lateral edges 2. In a variant, the whole blind could be made of an essentially elastic material. The guide tracks 3 could be pivot-mounted or fixed on the support 4. These last embodiments could even be combined with those in which the guide tracks 3 are mounted elastically on the support 4.

In the present invention, the blind preferably comprises a continuous, fully flexible tarpaulin, in contrast to blinds having horizontal bars—which may or may not be slightly flexible—at regular distances in order to guide the blind laterally.

I claim:

1. A closing device comprising a blind (1) having flexible lateral edges (2) each held in one of a pair of elongated guide tracks (3), each of said tracks having opposing sides and being mounted on a respective one of a pair of supports (4) in an elastic manner and pivotable about an axis essentially parallel to their longitudinal axis in such a way that tension exerted by said blind on the guide tracks is always divided substantially equally on both sides of said guide tracks with respect to the blind; and said guide tracks being capable of undergoing simultaneous translation and pivoting when operational.

2. A device according to claim 1, wherein the guide tracks (3) on the support (4) can undergo a displacement in the direction of the blind (1) when a force (6) is exerted on the latter.

3. A device according to claim 2, wherein the elastic means (5) are arranged so as to exert a constant traction on the lateral edges (2) of the blind (1).

4. A device according to claim 2, wherein the guide tracks (3) are arranged on rods (7) extending essentially perpendicularly to a longitudinal axis of said guide tracks (3) and mounted with a certain amount of play in holes provided in a wall of the support (4), said elastic means comprising a helical spring (5) slid over said rod (7) on the side of said wall (4) opposite the guide track (3), resting against said wall (4).

5. A device according to claim 4, wherein said rod (7) has a threaded free end (9) and is mounted coaxially in a sleeve (10) which extends with a certain amount of play through the hole (8) in a wall of the support (4), and is immobilized with respect to the guide track (3) by a nut (11) screwed onto the threaded free end (9) of the rod (7) , said spring (5) being held between said nut (11) and the surface of the wall of the support (4) facing the latter.

6. A device according to claim 2, wherein a flexible strip (12), is fitted between the guide track (3) and the support (4) on which said guide track is mounted.

7. A device according to claim 6, wherein a least one longitudinal edge (13) of the sealing strip (12) has holes through which said rods (7) run, said rods being fixed at certain distances from each other on back (14) of the guide tracks (3), said edge (13) being held close to said back (14) through the free end of sleeves (10) pointing towards said back (14) and pressing around said holes against said longitudinal edge (13) of the sealing strip (12).

8. A device according to claim 6, wherein the sealing strip (12) is folded to form a loop (15) between the guide track (3) and the support (4) on which said guide track (3) is mounted, and rods (7) carrying said guide track (13) passing through an end branch (16) of a loop (15) nearest the support (4), and a free edge (13) of the other branch (17) being fixed against the back of the guide track (3).

9. A device according to claim 1, wherein said closing device functions as a covering device.

10. A device according to claim 1, wherein said closing device functions as a separating device.

11. A device according to claim 1, wherein said closing device is a door.

12. A device according to claim 1, wherein said blind of said closing device is adapted to be mounted about a winding axis so that said blind can be wound thereabout for opening and closing said device.

13. A closing device comprising a blind (1) having flexible lateral edges (2) held in guide tracks (3), wherein said blind (1) has a narrow zone (33) of low strength, located between a lateral edge (2) and the surface of the blind itself (1), extending over the whole length of said edge (2), said zone (33) yielding as soon as the force acting on the surface of the blind (1) reaches a predetermined value, which is less than forces necessary to free the edge (2) from the guide tracks (3).

14. A device according to claim 13, wherein the blind comprises a tarpaulin wherein said narrow zone of low strength comprises an uninterrupted, essentially elastic zone (50) extending close to each of the lateral edges of the blind (1).

15. A device according to claim 14, wherein said essentially elastic zone extends close to each of the lateral edges of the blind (1).

* * * * *